US005188037A

United States Patent [19]

Mugnier

[11] Patent Number: 5,188,037

[45] Date of Patent: Feb. 23, 1993

[54] CHAIRLIFT OR GONDOLA-LIFT HAVING A FRICTION-BASED DRIVING DEVICE FOR CHAIRS OR CARS

[75] Inventor: Jean-Francois Mugnier, Fontaine, France

[73] Assignee: Pomagalski S.A., France

[21] Appl. No.: 852,645

[22] Filed: Mar. 17, 1992

[30] Foreign Application Priority Data

Apr. 2, 1991 [FR] France ..... 91 04081

[51] Int. Cl.[5] ..... B61B 13/00

[52] U.S. Cl. ..... 104/168; 104/178

[58] Field of Search ..... 104/168, 173.2, 178, 104/250, 165, 173.1; 105/149.1, 149.2

[56] References Cited

U.S. PATENT DOCUMENTS 3,596,607 8/1971 Pomagalski ..... 104/168
4,627,361 12/1986 Tarassoff ..... 104/178
4,671,186 6/1987 Kunczynski ..... 104/168
4,794,864 1/1989 Feuz et al. ..... 104/168
4,867,069 9/1989 Kunczynski ..... 104/168

*Primary Examiner*—Mark T. Le
*Attorney, Agent, or Firm*—Parkhurst, Wendel & Rossi

[57] ABSTRACT

Chairlift or gondola lift with a carriage supporting a gondola or a chair, the carriage including a detachable grip for coupling on a continuously moving cable. In the terminal, the carriage is uncoupled from the cable and it runs on a transfer rail. This transfer rail is equipped with friction drive sheaves for engaging a friction plate rigidly secured to the carriage. The sheaves are driven at a different speed with respect to the direct neighboring sheave so as to decelerate or to accelerate the carriage. The friction plate has a high friction coupling zone and a low friction coupling zone which permits a slip engagement with the friction sheave. The high friction coupling zone of the plate is shorter than the distance betwen two successive sheaves.

8 Claims, 3 Drawing Sheets

FIG. 5
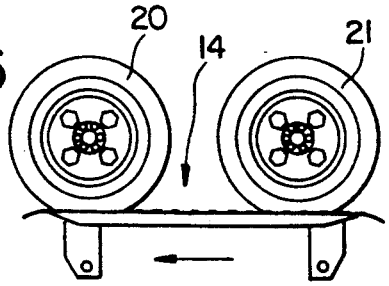
FIG. 5B
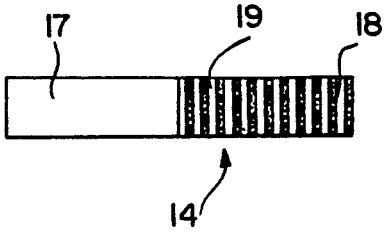
FIG. 6
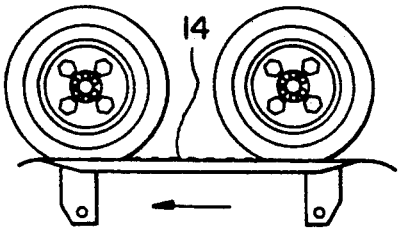
FIG. 6B
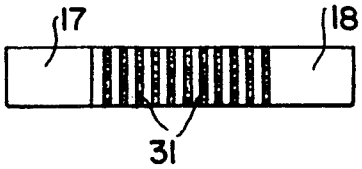
FIG. 7
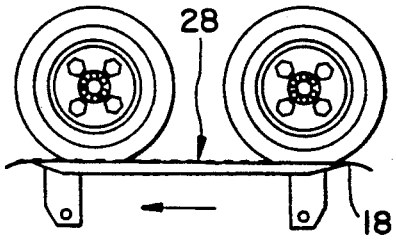
FIG. 7B
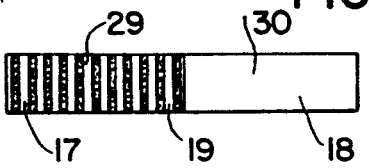
FIG. 8
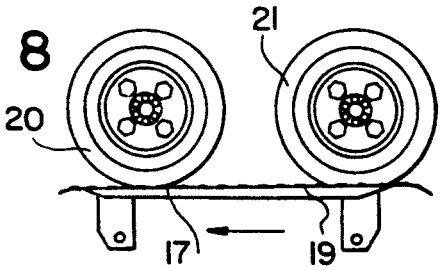
FIG. 8B
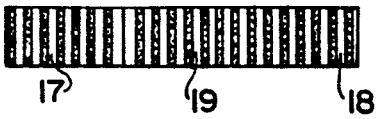
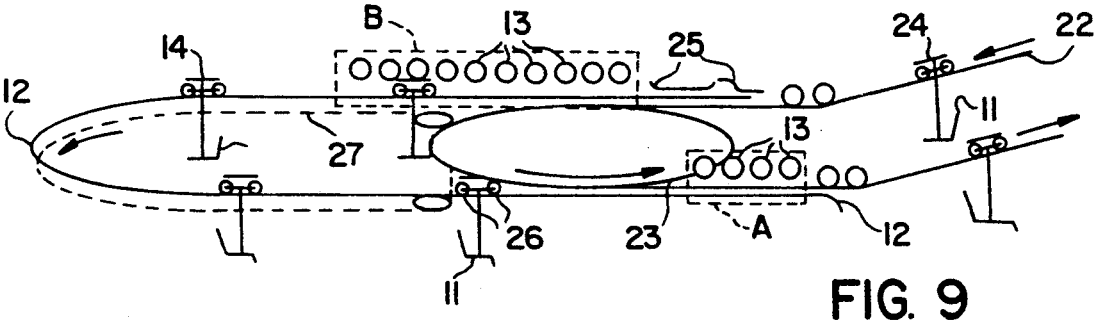
FIG. 9

CHAIRLIFT OR GONDOLA-LIFT HAVING A FRICTION-BASED DRIVING DEVICE FOR CHAIRS OR CARS

BACKGROUND OF THE INVENTION

The invention relates to a gondola lift or chairlift having a device for driving cars or chairs in stations or terminals. In such a lift, an aerial cable runs continuously in a closed circuit and the chairs are detached from the cable as they enter the station and travel through the station on a half-loop circuit, linking up and down tracks, before being reattached to the cable as they leave the station. As used herein, the expressions chairlifts and chairs shall respectively include gondola-lifts, cars, gondolas and similar apparatuses. The chairs are fixed by a hanger arm to a carriage bearing a grip for coupling the chair to the cable. The hanger arm includes rollers for running on a transfer rail extending in a half-loop circuit in the stations. The grip is of the detachable type permitting uncoupling of the carriage from the cable in the stations and the running of the carriage on a transfer guiding rail at a slow speed. Braking or deceleration, acceleration, and the driving of the uncoupled grip carriage in the stations may be provided by wheels or sheaves frictionally acting on a running friction plate rigidly secured to the grip carriage body. At least on the acceleration and/or deceleration sections, a battery or set of friction drive sheaves are staggered along the travel circuit in the station to cooperate with the friction plate. Immediately neighboring friction sheaves possess different circumferential velocities in order to stepwise decelerate or accelerate the chairs. The length of the friction plate is longer than the spacing or distance between two successive friction sheaves so that a carriage is always controlled by at least one friction sheave. Such a friction drive device is currently used for driving on the one hand the chairs detached from the cable through the station at a reduced speed and on the other hand for braking the carriage bearing these chairs at the entry to the station and for accelerating the carriages to synchronize the speeds of the carriages and of the cable before recoupling at the station exit. The drive sheaves dispose on the reduced speed sections of the circuit are driven in rotation by a motor at an equally reduced speed and the drive plate comes into contact with the following drive sheave smoothly, since the tangential speed of that sheave is equal to the speed of the drive plate. On the deceleration section the first sheave is driven at the speed of the cable whereas the speeds of the following sheaves are stepwise lower to decelerate the carriage. The front edge of the drive plate engages the following sheave while its rear edge is still engaged by the former sheave running at a greater speed and there results from the simultaneous engagement of two friction sheaves with the friction plate a pronounced wear. On the acceleration section the drive plate is in the same way engaged by sheaves running at different speeds. A driving device of this kind is for example described in the U.S. Pat. No. 4,563,955.

A chairlift which eliminates this drawback is known from the U.S. Pat. No. 4,794,864. In this prior art chairlift a spring is inserted between the friction sheave and its axis but such a device is quite complicated and expensive and does not prevent some jerk.

The object of the present invention is to provide a correct circulation of the carriages in the station. Another object is to effectively reduce the frictional wear of the sheaves, for instance constructed as pneumatic wheels or tires.

SUMMARY OF THE INVENTION

To reach this objective, the friction plate comprises in the lengthwise direction, corresponding to the direction of movement of the carriage, a high friction coupling zone and one or two low friction coupling zones. The central surface section of the frictional plate, which is never simultaneously engaged by two friction sheaves is a high friction coupling zone and the friction coupling of this central section is sufficient in order to prevent any slip between the friction sheave and the friction plate. At least one of the end surface sections of the friction plate has a lower friction coupling in order to allow some slip.

The friction plate always contacts with at least one friction sheave so that the carriage can be driven at starting of the installation. Two neighboring friction sheaves engaging simultaneously the friction plate never simultaneously contact the central section. The friction sheave contacting the high friction coupling zone drives the carriage at its circumferential velocity, and slip occurs between an adjacent friction sheave and the low friction coupling zone. The resultant wear is thus reduced.

The length of the central section is shorter than the distance between two successive friction sheaves, and the low friction coupling zone may be located at the fore section or at the rear section of the friction plate, or partly at both the fore and rear sections.

The friction coupling, or adherence between the friction sheave and the friction plate, is for instance given by the nature of the materials in contact, the roughness of the surfaces the contact area or the contact pressure. As it is not easy to reduce the pneumatic tire pressure for obtaining a lower friction coupling, one zone may be shifted with respect to the other so that the pneumatic tire is less compressed and provides a smaller contact area. It is easy to increase the roughness of the surface.

BRIEF DESCRIPTION OF THE DRAWINGS

Further objects and advantages of the invention will appear more clearly from the following detailed specification and annexed drawings in which:

FIG. 5 is a view similar to FIG. 3 showing the driving of a friction plate of the kind shown in a plan view on FIG. 5*b;*

FIGS. 6 and 6*b*; 7 and 7*b*; 8 and 8*b* are views similar to 5*b* showing alternative embodiments.

FIG. 9 is a schematic illustration viewed in perspective of a station of a chairlift.

DETAILED DESCRIPTION

Figure 1:
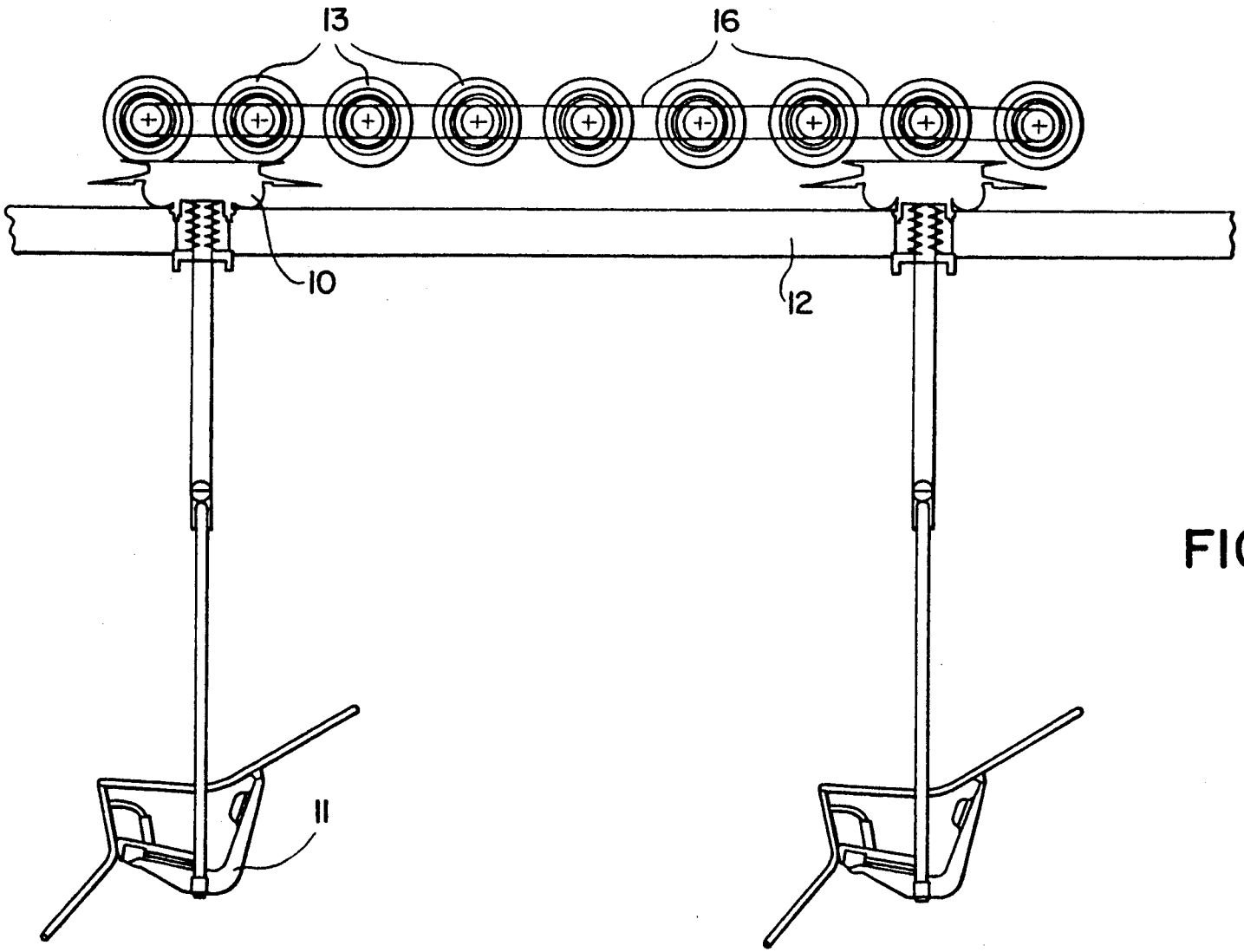
FIG. 1 is a schematic view in elevation of the friction drive device according to the invention.

With reference to the drawings, a continuously running cable 22 of an aerial ropeway, in particular of a gondola or chairlift extends from a bottom station to a top station, passing in these stations over a horizontal sheave 23 which guides the cable in a loop (opposite sheave not shown), one of these sheaves being a driving sheave. The aerial ropeway may be of the endless monocable type, or may include a hauling cable and a separate track cable. At the entrance in the station, the chairs 11 or gondolas are uncoupled from the cable 22 by opening of a grip 24 of the detachable type by passing along a grip actuating lever 25. The grip 24 comprises a chair 11 carrying carriage 10 including wheels 26 for riding on a transfer support rail 12 in the station. The carriage 10 runs at a slow speed on the transfer rail 12, particularly for the loading or unloading of the passengers. At the exit of the station, the carriage 10 is accelerated by friction drive sheaves 13 engaging the carriage 10 before the coupling on to the cable 22. At the entrance of the station the carriage 10 is uncoupled from the cable 22, and runs on rail 12 while being decelerated friction sheaves 13. The accelerating and decelerating friction sheaves 13 are staggered along acceleration and deceleration rail sections A and B, and each sheave 13 is equipped with a pneumatic tire 15 which engages a friction plate 14 of carriage 10. A transfer chain 27, having push fingers which engage the carriage 20, extends along the transfer rail 12, but it clear that the carriage 10 may be conveniently driven by friction sheaves or similar conventional devices.

The grip carriage 10 includes a friction plate 14 which extends horizontally in the travel direction of the carriage 10. The upper face of the plate 14 constitutes a friction face 28 cooperating with the friction sheaves 13. The length L of the friction plate 14 is longer than the distance D between two successive friction sheaves 13, and along the acceleration and deceleration sections A and B, friction plate 14 is always engaged by at least one friction sheave 13. The friction sheaves 143 staggered along the deceleration section B, which follow one another in the direction of movement of the chairs 11, possess decreasing rotational speeds so as to decelerate the chairs 11 uncoupled from the cable 22. The friction sheaves 13 of the acceleration section A possess increased rotational speeds. Each set of friction sheaves 13 is driven in rotation by any appropriate means, for instance by a motor, and the first sheave 13 of the deceleration set and the last sheave 13 of the acceleration set turn at the speed of the cable 22. The successive friction sheaves 13 are drivingly interconnected by belt 16 drive means having belt pulleys with different diameters so that the rotational speeds of the individual friction sheaves 13 of each such set decrease along the decelerations section B and increase along the acceleration section A.

Figure 2:
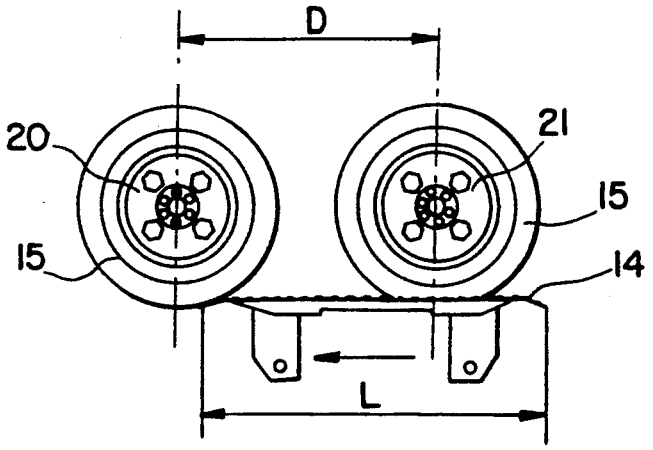
FIGS. 2, 3 and 4 are enlarged fragmentary views of FIG. 1, showing successive positions of the carriage.
Figure 3:
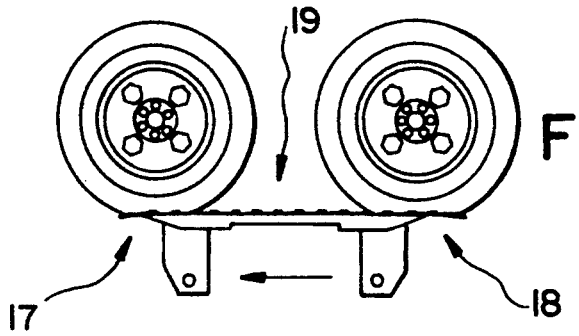
Figure 4:
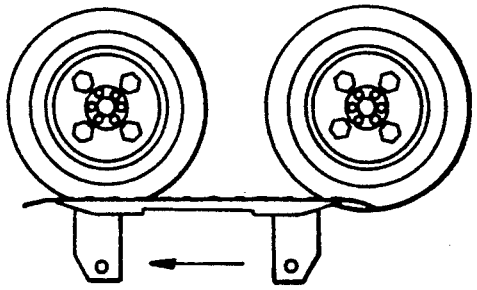

As will be seen by referring to FIGS. 2–4, the friction plate 14 is longitudinally subdivided into three sections, a central section 19 and two end sections 17, 18. The central section 19 is never in frictional simultaneous engagement with two friction sheaves 13, while the end sections 17, 18 may each be in simultaneous engagement with a respective sheave 13. The friction adherence of the central section 19 is higher than that of at least one of the end sections 17, 18. The friction coupling between a friction sheave 13 and the central section 19 provides a slip free driving of the carriage 10. In the position shown in FIG. 2 the preceding or upstream located friction sheave 21 is still in operative engagement with the central section 19 of the friction plate 14 and the chair 11 is driven in the direction of the arrow with a travel velocity corresponding to the circumferential speed of the sheave 21. The fore section of the friction plate 14 comes into engagement with the successive friction sheave 20 which follows in the chair 11 direction of travel. The carriage 10 arrives thus at the position shown in FIG. 3, where the fore section 17 of the friction plate 14 cooperates with the successive friction sheave 20 and the rear end section 18 with the preceding sheave 21. In the hereinafter described decelerating operation the successive friction sheave 20 is driven at a lower speed than the preceding sheave 21 and a frictional slip occurs between the plate 14 and the sheaves 21, 20. In the next position shown in FIG. 4 the rear end section 18 comes out of engagement of the preceding sheave 21 and the carriage 10 is driven by the successive sheave 20 at a lower speed. In the acceleration operation this speed would be higher.

According to the present invention, the friction plate 14 includes a high friction coupling zone 29 and one or two low friction coupling zones 30. The central section 19 is always a high coupling zone 29 and at least one of the end sections 17, 18 is a low coupling zone 30. As will be observed by inspecting FIGS. 5 and **5*b*, the surface of the friction plate 14 presents a low coupling zone 30 at the fore section 17, and a high coupling zone 29 at the central 19 and the rear 18 sections. The friction surface of the low coupling zone 30 is smooth and the friction surface of the high coupling zone 29 is provided with protuberances, for instance transversely extending ribs 31. In the position shown in FIG. 5, it is clear that the friction plate 14 is driven at the speed of the preceding friction sheave 21 in engagement with the high coupling zone 29 and that the low coupling zone 30 provides slip. The carriage 10 is conveyed in the direction of the arrow and thus arrives at the position where the friction plate 14 leaves the preceding sheave 21 and the high friction coupling zone 29 comes into engagement with the successive sheave 20, which now drives at its lower circumferential velocity the carriage 10. The carriage 10 and the chair 11 are thus decelerated without jerk. The length of the high friction coupling zone 29 is shorter than the interval between two neighboring sheaves 20, 21**.

As will be evident by referring to FIGS. 6 and **6*b* is the low friction coupling zones 30 may be at the fore section 17 and rear section 18 of the friction plate 14, and the high coupling zone at the central section 19. In the position shown in FIG. 6 the friction plate 14 is driven by the sheaves 20, 21, each contacting low coupling zone 30, whereby the adherence is sufficient to drive the friction plate 14. Thereafter the high coupling zone 29 comes into engagement with the successive sheave, 20, and the carriage 10 travels at the corresponding speed. As shown n FIGS. 7, 7*b*, the high coupling zone may be at the fore section 17 and the low coupling zone at the rear section 18**.

It is to be understood that similar or equivalent systems may be used to obtain the difference of adherence or friction coupling of the zones 29, 30. In FIGS. **8, 8*b*, similar to FIGS. 7, 7*b*, the low coupling zone 30 is slightly shifted downwards on FIG. 8 with respect to the high coupling zone 29, so that the successive sheave 20 is less compressed and the contact area between the sheave 20 and the friction plate 14 smaller. It is clear that the coupling zones 29, 30 may be of different materials, and that the systems to obtain a coupling difference can be combined. Further, the high and low coupling zones 29, 30** may overlap in so far that adherence progressively decreases or increases so as to reduce speed variations.

What is claimed is:

1. An overhead cable transport installation, comprising:

a closed-looped cable extending between two transfer rails, one side of said loop defining an uphill side and an opposite side of said loop defining a downhill side, each of said two transfer rails disposed at an opposite end of said closed-looped cable between said uphill and downhill sides;

a plurality of carriages each supporting a chair, each of said carriages comprising a detachable grip for de-coupling said chair from said closed-loop cable, support wheels to allow said carriage to roll along each of said two transfer rails, and a friction plate extending lengthwise along a carriage travel direction, said friction plate having a friction face;

a grip actuation device to de-couple said grip from said closed-loop cable so that said carriage may roll along each of said two transfer rails; and a plurality of friction sheaves spaced along opposite ends of each of sid two transfer rails to frictionally engage said friction face of said friction to drive said carriage along each of said two transfer rails, said sheaves being spaced apart a predetermined distance, and said friction plate being longer than said predetermined distance;

wherein said friction face comprises at least one low friction coupling zone and a high friction coupling zone, said high friction coupling zone extending along said friction face a distance shorter than said predetermined distance.

2. The installation of claim 1, wherein said at least one low friction coupling zone is defined by one low friction coupling zone which extends along one end of said friction face, said high friction coupling zone extending along an opposite end of said friction face.

3. The installation of claim 1, wherein said at least one low friction coupling zone is defined by two low friction coupling zones, wherein said high friction coupling zone is disposed between said two low friction coupling zones.

4. The installation of claim 1, wherein said friction face comprises raised ridges disposed along said high friction coupling zone.

5. The installation of claim 1, wherein said high friction coupling zone is made of a different material than that of said at least one low friction coupling zone.

6. The installation of claim 1, wherein said at least one low friction coupling zone is disposed further away from said plurality of friction sheaves than said high friction coupling zone, thereby reducing contact with the friction sheaves in the low friction coupling zone with respect to said high friction coupling zone.

7. The installation of claim 1, further comprising belt drive means to drive rotatably said plurality of friction sheaves.

8. The installation of claim 1, wherein each of said plurality of sheaves is equipped with a pneumatic tire.

* * * * *